US008220109B2

(12) United States Patent
Medema et al.

(10) Patent No.: US 8,220,109 B2
(45) Date of Patent: Jul. 17, 2012

(54) HANDHELD PET HAIR VACUUM CLEANER

(75) Inventors: Douglas J. Medema, Belding, MI (US); Timothy S. Parker, Rockford, MI (US); Tom Minh Nguyen, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 554 days.

(21) Appl. No.: 12/403,714

(22) Filed: Mar. 13, 2009

(65) Prior Publication Data

US 2009/0229070 A1 Sep. 17, 2009

Related U.S. Application Data

(60) Provisional application No. 61/036,543, filed on Mar. 14, 2008.

(51) Int. Cl.
*A47L 9/02* (2006.01)

(52) U.S. Cl. ..... 15/416; 15/415.1; 15/418

(58) Field of Classification Search ..... 15/415.1, 15/416, 418
See application file for complete search history.

(56) References Cited

U.S. PATENT DOCUMENTS

| | | | | |
|---|---|---|---|---|
| 2,953,808 | A * | 9/1960 | Carmack | 15/365 |
| 4,209,875 | A | 7/1980 | Pugh et al. | |
| 4,573,237 | A | 3/1986 | Kochte et al. | |
| 4,577,365 | A | 3/1986 | Yuen | |
| 4,776,059 | A * | 10/1988 | Worwag | 15/334 |
| 4,831,685 | A | 5/1989 | Bosyj et al. | |
| 4,920,608 | A | 5/1990 | Hult et al. | |
| 4,967,443 | A | 11/1990 | Krasznai et al. | |
| 5,005,252 | A | 4/1991 | Steiner et al. | |
| 5,347,679 | A * | 9/1994 | Saunders et al. | 15/416 |
| 5,561,885 | A * | 10/1996 | Zahuranec et al. | 15/323 |
| 6,546,592 | B1 | 4/2003 | Cockburn et al. | |
| 7,140,069 | B1 | 11/2006 | Dangerfield et al. | |
| 7,418,763 | B2 * | 9/2008 | Shaver et al. | 15/330 |
| 2005/0050675 | A1 | 3/2005 | Hsu | |

FOREIGN PATENT DOCUMENTS

| | | | |
|---|---|---|---|
| AU | 739577 | B2 | 12/1998 |
| CA | 2086455 | A1 | 12/1992 |
| EP | 0100438 | A | 2/1984 |
| EP | 0619978 | A1 | 10/1994 |
| WO | 2004075709 | A2 | 9/2004 |
| WO | 2006076363 | A2 | 7/2006 |
| WO | 2009012640 | A1 | 1/2009 |

* cited by examiner

*Primary Examiner* — Lee D Wilson
*Assistant Examiner* — Shantese McDonald
(74) *Attorney, Agent, or Firm* — McGarry Bair PC

(57) ABSTRACT

A handheld vacuum cleaner according to the invention comprises a housing, a dirt cup, a latch coupled between the dirt cup and the housing for selectively joining the dirt cup to the housing, a filter positioned in the dirt cup between the inlet and the outlet, and a plurality of different nozzle assemblies, each having at least one nozzle opening and each having an outlet opening at a back end thereof that is removable coupled to the dirt cup front end.

15 Claims, 7 Drawing Sheets

HANDHELD PET HAIR VACUUM CLEANER

CROSS-REFERENCE TO RELATED APPLICATIONS

This application claims the benefit of U.S. Provisional Patent Application No. 61/036,543, filed Mar. 14, 2008, which is incorporated herein by reference in its entirety.

BACKGROUND OF THE INVENTION

1. Field of the Invention

This invention relates to vacuum cleaners. In one of its aspects, the invention relates to a portable, handheld vacuum cleaner adapted to remove pet hair from carpet and other fabric surfaces. In another of its aspects, the invention relates to a vacuum cleaner having interchangeable nozzles.

2. Description of the Related Art

Household pets, such as dogs and cats, tend to shed hair, which collects on carpets, furniture, and other areas of the home. A common complaint of pet owners is the seemingly never-ending battle to remove the pet hair. Pet hair and other similar debris can be relatively small and difficult to collect, even with conventional vacuum cleaners. This is because the pet hair works its way into crevices and between the fibers of carpet and fabric. Pet hair vacuum cleaners can include nozzles having bristles, rotating agitators, or otherwise moving parts to loosen and remove pet hair and other similar debris. However, the pet hair can collect at such parts, thereby impeding the operation and effectiveness of the vacuum cleaner. In addition, these nozzles work well for removing pet hair from some surfaces but not others. A nozzle having bristles or a moving agitator may work well for removing pet hair from carpet, but the nozzle could damage the delicate fabric of a cashmere blanket.

U.S. Pat. No. 4,209,875 discloses a hand-held cordless electric vacuum cleaner having separable power and bowl units secured by a releasable latch. The bowl comprises a hollow bowl provided with an air inlet opening and an integrally molded internal nozzle. The bowl contains a filter assembly including a ring and a filter bag positioned wholly within the bowl between the air inlet opening and a fan. When the vacuum is not in use, a flapper prevents dirt in the bowl from spilling through the opening by covering the nozzle.

U.S. Pat. No. 4,967,443 discloses a vacuum cleaner comprising housing and a fan driven by a motor in the housing to produce suction. Foreign matter, liquid, and air are drawn into a nozzle formed integrally with the canister by the vacuum produced by the fan. A filter assembly of the canister comprises a filter for filtering the air entering the canister and a filter housing for housing the filter. The filter is removably and positively secured to the filter housing to allow the filter and the filter housing to form an integral unit.

U.S. Pat. No. 6,546,592 discloses a vacuum cleaner comprising a housing portion and nose cone releasably fitted thereon by the engagement of detent members provided on the housing portion with co-operating recesses provided in the nose cone. The nose cone comprises an inlet tube and a deflector provided at the rear end of the inlet tube for deflecting dust and debris downwardly into a collecting chamber in the nose cone. The detent members can be retracted from the recess by depressing a release lever against the force of a spring in order to remove the nose cone from the housing portion to empty the collecting chamber.

SUMMARY OF THE INVENTION

A handheld vacuum cleaner according to the invention comprises a housing including a handle for carrying the vacuum cleaner, the housing having an inlet opening and a dirt cup connector surrounding the inlet opening; a motor/fan assembly in the housing for generating a suction force through the inlet opening; a dirt cup comprising a relatively hollow body having an inlet at a front end and an outlet at a back end, the back end of the dirt cup having a housing connector that is adapted to mate with the dirt cup connector to removably join the dirt cup to the housing; a latch coupled between the dirt cup and the housing for selectively joining the dirt cup to the housing; a filter positioned upstream of the motor/fan assembly; and a plurality of different nozzle assemblies, each having at least one nozzle opening and each having an outlet opening at a back end thereof that is removably coupled to the dirt cup front end.

In one embodiment, one of the plurality of nozzle assemblies has pet hair removing elements.

In another embodiment, the pet hair removing elements are formed of an elastomeric material.

In another embodiment, one of the plurality of different nozzle assemblies includes a pair of spaced surfaces which are angularly related, and each of the pair of spaced surfaces has one of the nozzle openings.

In another embodiment, one of the plurality of different nozzle assemblies comprises an elastomeric portion including at least one nozzle opening and an interfacing frame, and the elastomeric portion is overmolded onto the interfacing frame.

In another embodiment, each of the plurality of different nozzle assemblies is interchangeably coupled to the dirt cup by an interfacing frame.

In another embodiment, the vacuum cleaner further comprises a nozzle latch positioned between the dirt cup front end and each of the plurality of different nozzle assemblies for selectively coupling each of the plurality of different nozzle assemblies to the dirt cup front end.

In another embodiment, the filter is positioned in the dirt cup between the inlet and outlet.

In another embodiment, the handle comprises a first end that is mounted to a rear portion of the housing and extends upwardly and forwardly ending in a free end.

In another embodiment, the vacuum cleaner further comprises a power switch connected to the motor/fan assembly on the free end of the handle for controlling power to the motor/fan assembly.

In another embodiment, the vacuum cleaner further comprises an elongated hollow suction arm having a connecting end and a suctioning end, wherein the suction arm is mounted to the dirt cup at the connecting end for rotation from an operational position in which the suctioning end is extended beyond the nozzle assembly and non-operational position in which the suctioning end is positioned alongside the dirt cup, and wherein the connecting end has an opening in fluid communication with the dirt cup, and wherein the suctioning end comprises an elongated suction opening.

In another embodiment, the vacuum cleaner further comprises an interfacing frame between the dirt cup and the at least one nozzle assembly molded of an elastomeric material.

In another embodiment, the interfacing frame is molded of a relatively rigid material and has an inner surface adapted to conform to at least a portion of the front end of the dirt cup.

In another embodiment, the interfacing frame further comprises an outer surface including a plurality of ridges for frictionally retaining the at least one of the plurality of nozzle assemblies molded of an elastomeric material on the front end of the dirt cup.

In another embodiment, the vacuum cleaner further comprises a latch between the dirt cup and the at least one of the plurality of nozzle assemblies molded of an elastomeric material for removably retaining the at least one of the plurality of nozzle assemblies molded of an elastomeric material on the front end of the dirt cup.

In another embodiment, each of the plurality of different nozzle assemblies is removably coupled to the dirt cup front end by a latch.

In another embodiment, a handheld vacuum cleaner according to the invention comprises a housing including a handle for carrying the vacuum cleaner, the housing having an inlet opening and a dirt cup connector surrounding the inlet opening; a motor/fan assembly in the housing for generating a suction force through the inlet opening; a dirt cup comprising a relatively hollow body having an inlet at a front end and an outlet at a back end, the back end of the dirt cup having a housing connector that is adapted to mate with the dirt cup connector to removably join the dirt cup to the housing; a latch coupled between the dirt cup and the housing for selectively joining the dirt cup to the housing; a filter positioned in the dirt cup between the inlet and the outlet; a nozzle assembly having at least one nozzle opening in fluid communication with the dirt cup front end; and an elongated hollow suction arm having a connecting end and a suctioning end, wherein the suction arm is mounted to the dirt cup at the connecting end for rotation from an operational position in which the suctioning end is extended beyond the nozzle assembly and non-operational position in which the suctioning end is positioned alongside the dirt cup, and wherein the connecting end has an opening in fluid communication with the dirt cup, and wherein the suctioning end comprises an elongated suction opening.

According to another embodiment, the opening in the connecting end is formed in a bearing that is received within an opening in the dirt cup for rotatably mounting the suction arm to the dirt cup.

According to another embodiment, the bearing is snap fit into the opening in the dirt cup.

DESCRIPTION OF THE PREFERRED EMBODIMENTS

Figure 1:
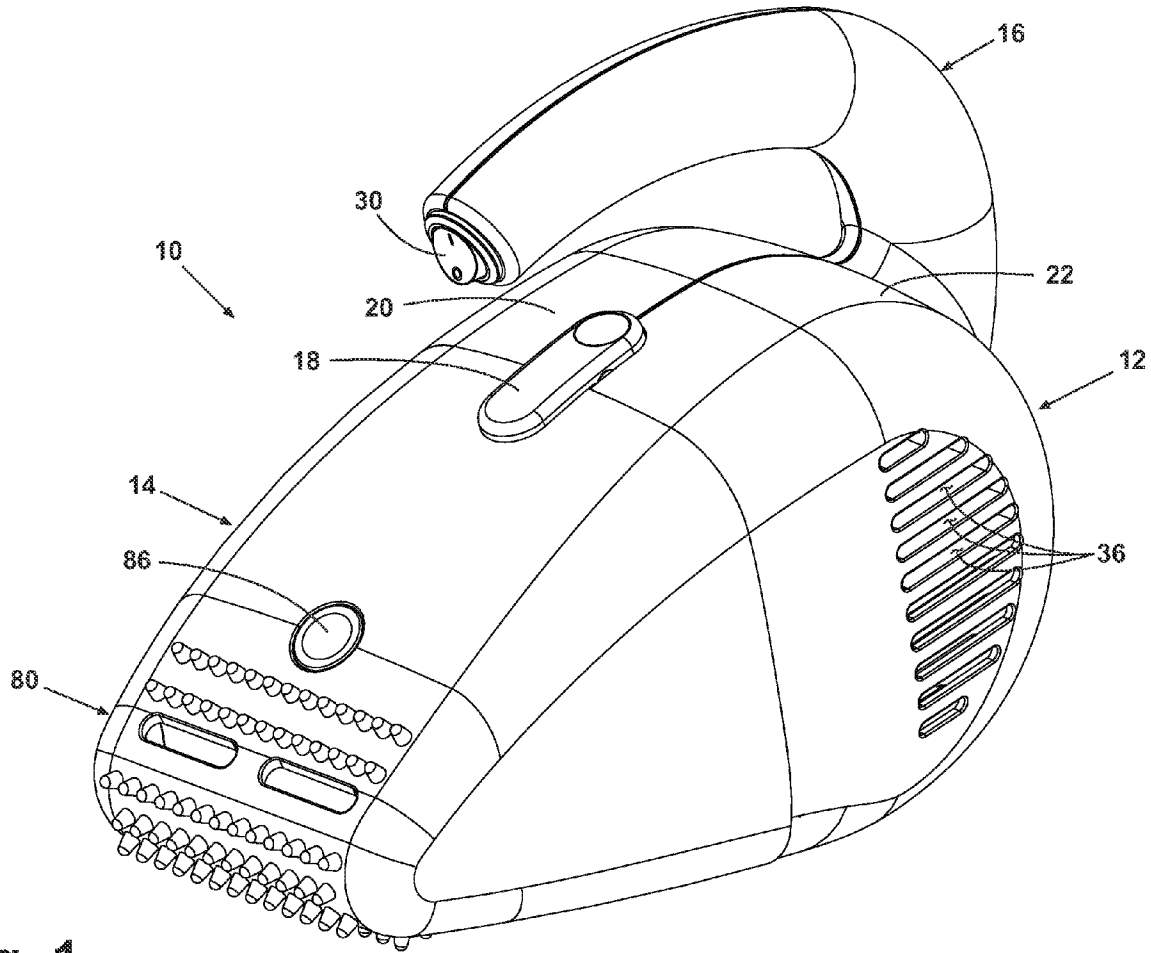
FIG. 1 is a perspective view of a handheld pet hair vacuum cleaner according to a first embodiment of the invention with a flexible nozzle removably attached thereto.
Figure 2:
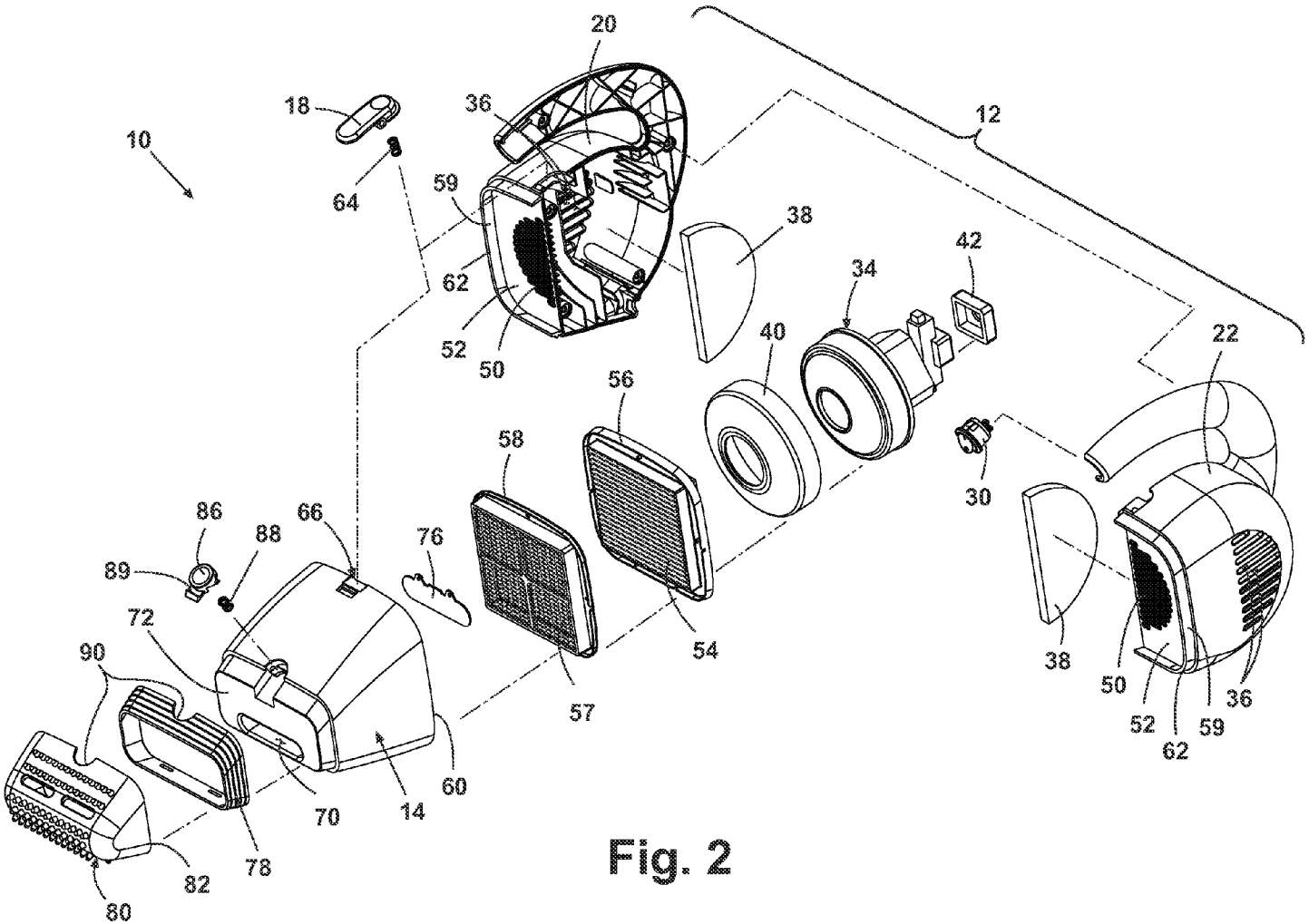
FIG. 2 is an exploded view of the vacuum cleaner and flexible nozzle from FIG. 1.

Referring now to the drawings and in particular to FIGS. 1 and 2, a handheld pet hair vacuum cleaner 10 comprises a housing 12 including a handle 16, and a dirt cup 14 removably attached to the housing 12 by a dirt cup latch 18. The housing 12 forms a cavity for housing various components of the vacuum cleaner 10. The vacuum cleaner 10 is of the handheld variety and can be relatively lightweight so as to increase portability. The vacuum cleaner 10 can be used to clean fabric-covered surfaces, such as carpets, rugs, and upholstery, and bare surface, such as hardwood, linoleum, and tile. Although the invention is described with respect to a dry vacuum, the vacuum can also be adapted for wet vacuuming and extraction. As used herein, the term "dry vacuuming" includes collecting relatively dry dirt and debris from a surface to be cleaned, and "wet vacuuming" includes collecting liquids and relatively wet dirt and debris from a surface to be cleaned. "Extraction" cleaning includes delivering a cleaning fluid to a surface to the cleaned, and removing the spent cleaning fluid, dirt, and debris from the surface to be cleaned.

The housing 12 comprises a first housing portion 20 mated with a second housing portion 22. The housing portions 20, 22 can be coupled together in any suitable manner, such as by using mechanical fasteners (e.g., screws or pins), an adhesive, connecting elements integrally formed with the housing portions 20, 22 and adapted to couple the housing portions 20, 22 together, or heat sealing. Alternatively, the housing 12 can be formed as a single piece. The housing 12 can be formed of any suitably durable and lightweight material, such as molded plastic. The handle 16 extends upwardly and forwardly from a rear of the housing 12 such that one end of the handle 16 extends over the housing 12. The handle 16 can be formed integrally with the housing 12 and of the same material as the housing 12. Alternatively, the handle 16 can be formed separately from the housing 12. The handle 16 can be formed of the same or a different material and can be attached to the housing 12 in any suitable manner, such as by mechanical fasteners, an adhesive, connecting elements integrally formed with the housing 12 and handle 16 and adapted to couple the housing 12 and handle 16 together, or heat sealing. The handle 16 can further include an overmolded grip with a soft durometer material for providing a comfortable hand grip to the user.

A conventional power switch 30 adapted to be actuated by a user is captured between the two housing portions 20, 22 on a free end of the handle 16. The switch 30 controls the supply of electrical power to a suction source of the vacuum cleaner 10, as will be described below. Power can be provided to the suction source by an electrical cord (not shown), by one or more batteries (not shown), or by any other suitable source. If power is provided by an electrical cord, the housing 12 can further comprise an electrical cord mount (not shown) attached on a side thereof for wrapping the cord for storage. The electrical cord mount can optionally incorporate known cord mount features, such as a cord winding mechanism or cord cover.

The housing 12 defines a cavity which receives a conventional motor/fan assembly 34 for generating a flow of working air through the vacuum cleaner 10. The motor can be a direct-current motor powered by rechargeable batteries carried within the housing 12, or an alternating-current motor of known construction supplied power from an external source through the electrical cord.

A plurality of exhaust openings 36 are included on each housing portion 20, 22. The exhaust openings 36 are illustrated as homogenous elongated slits having rounded ends. Alternatively, the exhaust openings 36 can comprise any shape or combination of shapes suitable for the purposes described herein, for example but not limited to polygons, circles, ovals, irregular shapes, and the like, or any combinations thereof. Exhaust filters 38, which can be but are not limited to HEPA filters, for filtering the air exhausted by the motor/fan assembly prior to the air entering the atmosphere are positioned against an interior face of each portion 20, 22 adjacent the exhaust openings 36 such that air must pass through the exhaust filters 38 prior to passing through the exhaust openings 36. The exhaust filters 38 can be attached to the exhaust openings 36 by an adhesive or in any other suitable manner. Alternatively, the exhaust filters 38 can be maintained in a position against the exhaust openings by elements of the housing 12.

The motor/fan assembly 34 is supported within the housing 12 by a resilient front motor seal 40 and a rear motor support bracket 42 adapted to surround the motor/fan assembly 34 and contact the interior walls of the housing 12. The housing 12 is formed to securely hold and position the motor/fan assembly 34 therein. The motor support bracket 42 can be formed of any material and have any shape suitable for supporting the motor/fan assembly 34 in the housing 12. As illustrated, the front motor seal 40 has a generally circular cross-section, while the rear motor support bracket 42 has a generally square cross-section. An inlet 50 to the motor/fan assembly 34 comprises a plurality of openings in a vertical wall 52 of the housing 12. The front motor seal 40 is positioned adjacent the inlet 50 and around a front portion of the motor/fan assembly 34. The rear support bracket 42 is positioned about a rear portion of the motor/fan assembly.

A frame 56 mounts a conventional pleated air filter 54 for removing dirt debris from the working air and a primary filter frame 58 are positioned adjacent the inlet 54 on a side of the inlet 50 opposite the motor/fan assembly 34. The filter frame 58 mounts a porous screen material to capture pet hair upstream of the pleated filter 54. The frame 56 and filter frame 58 are adapted to align at a periphery thereof with a flange 59. The flange 59 extends forwardly about a periphery of the wall 52.

A back end 60 of the dirt cup 14 is removably coupled to a front end 62 of the housing 12 by the dirt cup latch 18, which is adapted to secure the dirt cup 14 about the flange 59 in a manner creating a relatively airtight connection between the housing 12 and the dirt cup 14. The dirt cup 14 and housing 12 together form a working air conduit extending therethrough. Dirt cup latch 18 is a conventional spring-biased latch and is biased upwardly by spring 64. Dirt cup latch 18 is adapted to be releasably retained in a dirt cup latch receiving detent 66 formed in the back end 60 of the dirt cup 14. Dirt cup latch 18 is mounted to the housing 12 such that a user can press downwardly on the dirt cup latch 18 while the latch is retained in the detent 66 and pull the dirt cup 14 away from the housing 12 to disconnect the dirt cup 14 from the housing 12.

An inlet 70 to the dirt cup 14 is formed at a front end 72 thereof so as to enable the passage of working air therethrough. The vertical cross section of dirt cup 14, which is substantially hollow, gradually decreases in size from the back end 60 to the front end 72 of the dirt cup 14 to produce a tapering effect. The front end 72 of the dirt cup 14 is also slightly recessed about its perimeter relative to the rest of the dirt cup 14.

A flap gasket 76 is movably mounted to an interior of the front end 72 of the dirt cup 14 at the inlet 70 so as to selectively cover the inlet 70. The flap gasket 76 is adapted to rotate backwards and upwards from the inlet 70 due to the backward movement of working air through the inlet 70 caused by suction forces during operation of the vacuum cleaner 10 so as to uncover the inlet 70 and enable dirt entrained in the working air to pass into the dirt cup 14. The flap gasket 76 will rotate back to a position covering the inlet 70 when suction is no longer present in the vacuum cleaner 10. In this manner, the flap gasket prevents dirt in the dirt cup 14 from spilling forward through the inlet 70.

An interfacing frame 78 is adapted to fit around the recessed perimeter on the front end 72 of the dirt cup 14 and can be made of any material suitable for the purposes described herein, such as an injected molded and relatively rigid thermoplastic material. The interfacing frame 78 can be removably coupled to the front end 72 of the dirt cup 14 in any suitable manner, such as by a friction fit. As illustrated herein, the interfacing frame 78 has a substantially rectangular shape and an inner surface adapted to conform to at least a portion of the recessed perimeter on the front end 72 of the dirt cup 14. The interfacing frame 78 can include a plurality of ridges or projections on an outer surface thereof.

A back end 82 of a flexible nozzle 80 can be overmolded onto the interfacing frame 78. Alternatively, the back end 82 can be friction fit onto the interfacing frame 78. In either case, the interfacing frame 78 strengthens the back end 82 of the flexible nozzle 80 to strengthen the connection between the flexible nozzle 80 and the dirt cup 14 when the nozzle is mounted to the dirt cup 14. The ridges or projections on the interfacing frame 78 can aid in connecting the back end 82 of the flexible nozzle 80 to the interfacing frame 78, particularly when the back end 82 and interfacing frame 78 are connected by a friction fit.

The flexible nozzle 80 can be removably attached to the front end of the dirt cup 14 by a nozzle latch 86, which is adapted to secure the nozzle 80 about the recessed perimeter on the front end 72 of the dirt cup 14 in a manner creating an airtight connection between the nozzle 80 and the dirt cup 14. Nozzle latch 86 is a conventional spring-biased latch and is biased upwardly by spring 88. The nozzle latch 86 can further comprise a retaining knob or flange 89. Nozzle latch 86 is adapted to be releasably retained in a nozzle latch receiving opening 90 formed at the back end 82 of the flexible nozzle 80 and in the interfacing frame 78 while the retaining flange 89 slides under the interfacing frame 78 to pin the interfacing frame 78 and nozzle 80 between the flange 89 and the rest of the nozzle latch 86. Nozzle latch 86 is mounted to the dirt cup 14 so that a user can press downwardly on the nozzle latch 86 while the latch is retained in the opening 90 and pull the flexible nozzle 80 away from the dirt cup 14 to disconnect the flexible nozzle 80 from the dirt cup 14.

Figure 3:
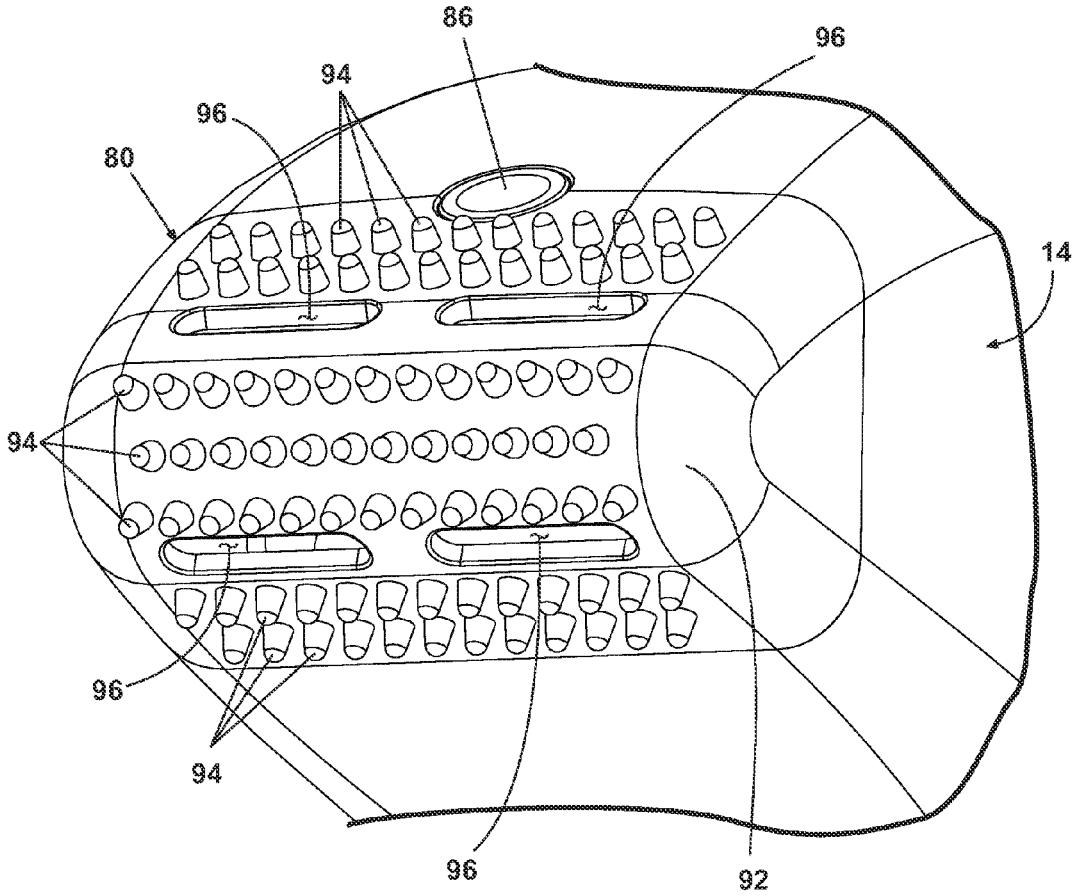
FIG. 3 is an enlarged view of the flexible nozzle removably attached to the vacuum cleaner from FIG. 1.

As illustrated in FIG. 3, the flexible nozzle 80 is an integrally molded structure comprising a rounded body 92 having a plurality of projections or nubs 94 extending in a perpendicular manner therefrom. The nubs 94 can have any shape suitable for the purposes described herein, such as but not limited to the outwardly-tapered cylindrical shape illustrated herein. Alternatively, the nubs 94 can be generally curved, flat, pointed, spherical, or polygonal shapes, or any combination thereof. The nubs 94 can also comprise a plurality of differently shaped nubs, if desired. The flexible nozzle 80 can be formed of any relatively flexible or elastomeric material, such as rubber or thermoplastic elastomers. Alternatively, the flexible nozzle 80 can include bristles, scrapers, squeegees, sponges, or any other similar elements instead of, or in addition to, the nubs 94. The flexible nozzle 80, dirt cup 14, and housing 12 together form a working air conduit extending therethrough. The flexible nozzle 80 further comprises at least one and preferably more than one opening 96 that are in fluid communication with the working air conduit to form a plurality of flexible nozzle openings 96 in the flexible nozzle 80.

Figure 4:
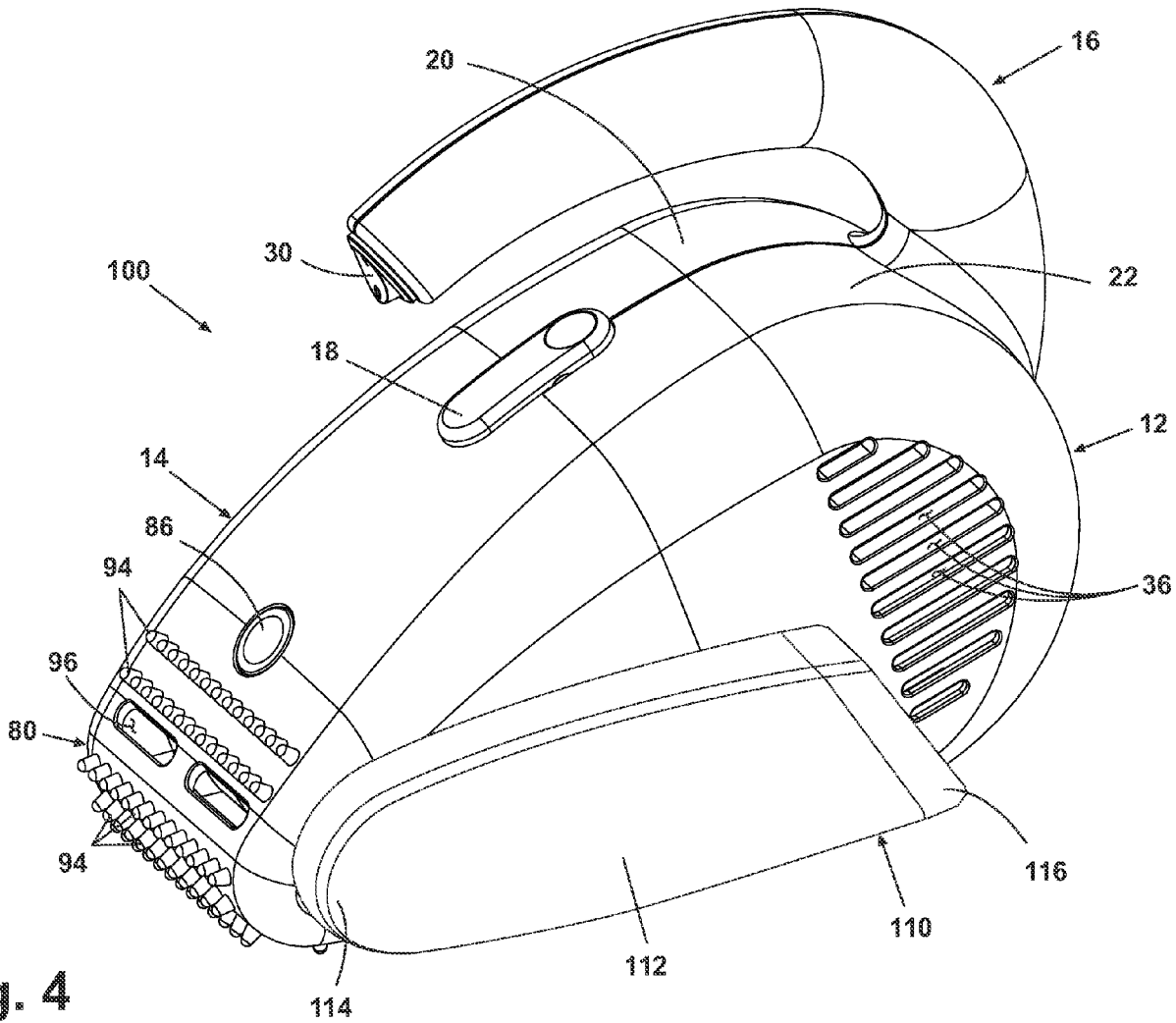
FIG. 4 is perspective view of a handheld pet hair vacuum cleaner according to a second embodiment of the invention with a suction arm in a non-operational position.
Figure 5:
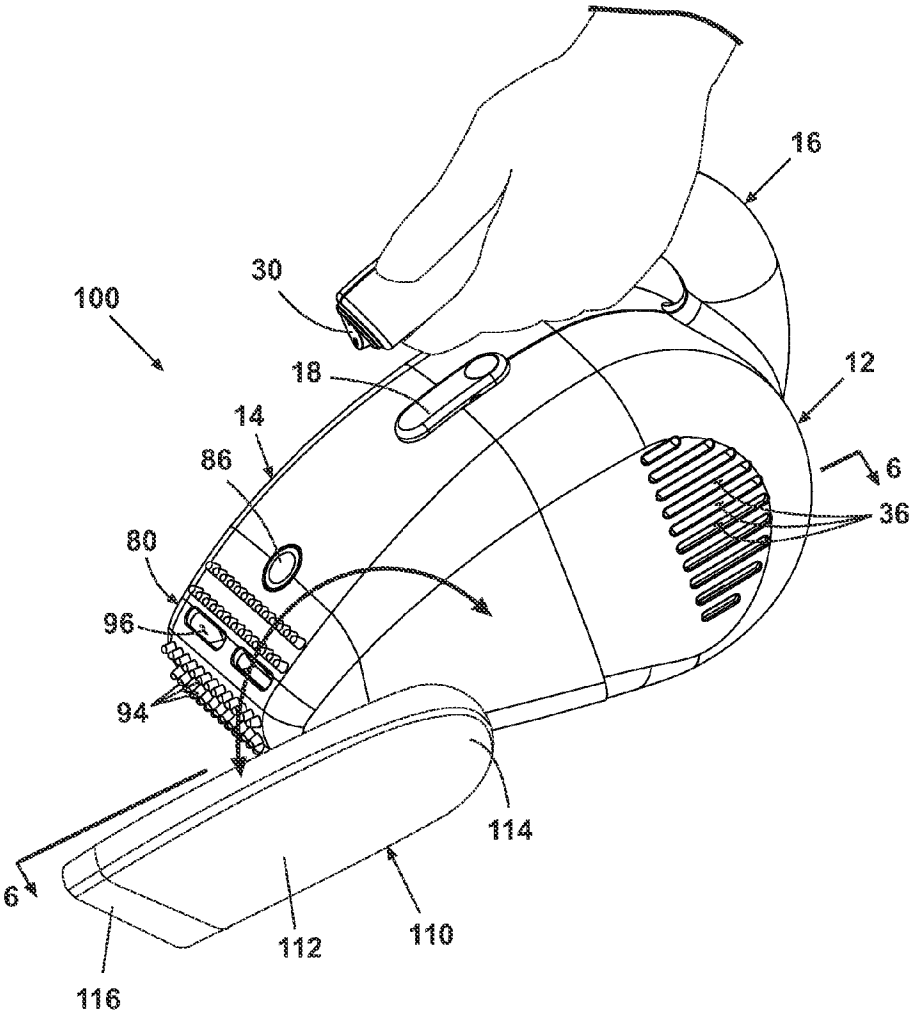
FIG. 5 is perspective view of the handheld pet hair vacuum cleaner of FIG. 4 with a suction arm in an operational position.
Figure 6:
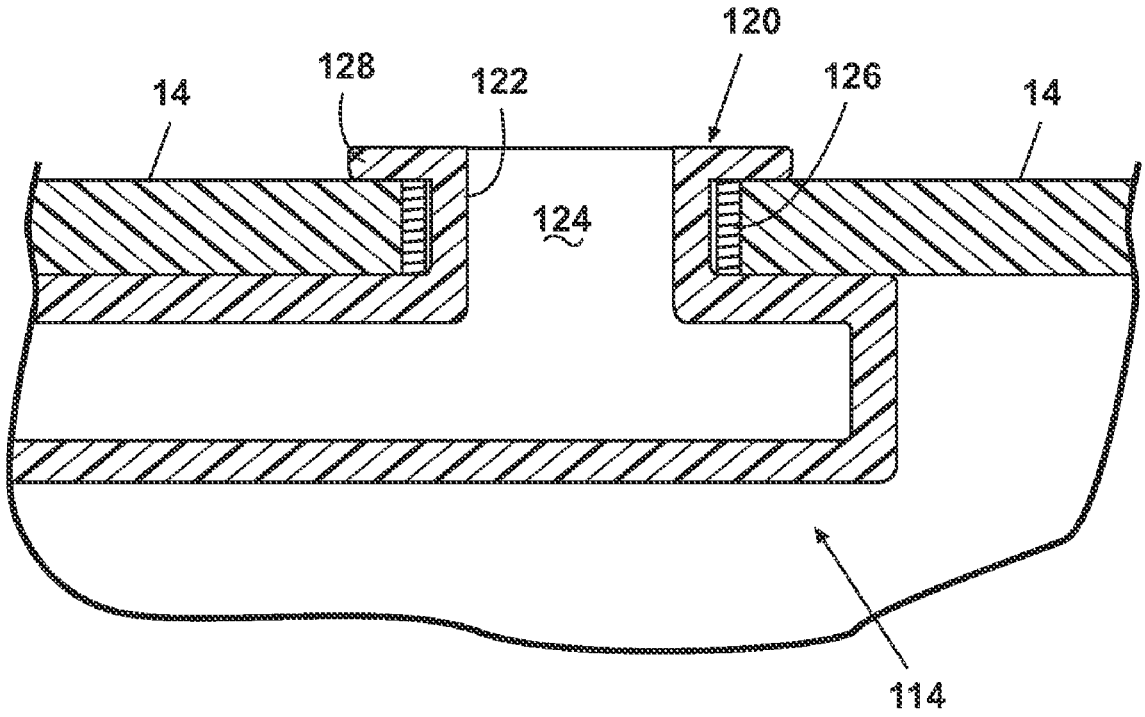
FIG. 6 is a schematic view of a portion of the vacuum cleaner taken along line 6-6 of FIG. 5.

A second embodiment of a vacuum cleaner 100 according to the invention is illustrated in FIGS. 4-6. The vacuum cleaner 100 is identical to the vacuum cleaner 10 except for the addition of a rotating suction arm 110 connected to the dirt cup 14. The rotating suction arm 110 comprises a relatively rectangular elongated hollow body 112 and has a connecting end 114 and a suctioning end 116. The connecting end 114 can be rotatably mounted to the dirt cup 14 in any suitable manner providing selective fluid communication between the suctioning end 116 and the dirt cup 14. As illustrated in FIG. 6, the connecting end 114 is formed with a mounting portion 120 configured to be snap fit into a connecting opening in the dirt cup 14. The mounting portion 120 comprises a generally cylindrical neck 122 extending perpendicularly from the body 112 at the connecting end 116 and having an opening 124 in fluid communication with both the interior of the rotating suction arm 110 and the interior of the dirt cup 14. The portion of the neck 122 that is received by the opening in the dirt cup 14 is surrounded by a conventional bearing 126 for enabling rotation of the neck 122 within the opening in the dirt cup 14. A flange 128 on the neck 122 spaced from the body 112 serves to retain the mounting portion 120 within the opening in the dirt cup 14. The suctioning end 116 of the rotating suction arm 110 forms an elongated suction opening (not shown) in fluid communication with the interior of the rotating suction arm 110 such that the suction opening is in selective fluid communication with the working air conduit.

When in the non-operational position illustrated in FIG. 4, the rotating suction arm 110 and suction opening are fluidly disconnected from the working air conduit, and the suctioning end 114 is positioned alongside the dirt cup 14. When rotated into the operational position illustrated in FIG. 5, the rotating suction arm 110 and suction opening are fluidly connected to the working air conduit, and the suctioning end 114 is extended beyond the nozzle. This selective fluid connection to the working air conduit can be accomplished by an air flow control mechanism (not shown) comprising a structure or device adapted to, in effect, temporarily disconnect the nozzle 80 from the working air conduit when the rotating suction arm 110 is in the operational position to provide maximum suctioning power to the rotating suction arm 110. The air flow control mechanism prevents working air from flowing into the dirt cup 14 via the inlet 70 when the rotating suction arm 110 is in the operating position. The air flow control mechanism can be automatically or manually operated. For example, the air flow control mechanism can automatically close and open the fluid connection between the nozzle and the working air conduit as the rotating suction arm 110 moves between the operational and non-operational positions, respectively. One example of a suitable air flow control mechanism is a device or structure adapted to automatically maintain the flap gasket 76 in a position covering the inlet 70 to fluidly disconnect the nozzle 80 from the working air conduit when the rotating suction arm 110 is in the operational position. Alternatively, the air flow control mechanism can be a detachable cover (not shown) that can be attached to the vacuum 100 by a user when the user desires to use the rotating suction arm 110 and detached by the user when the user is done using the rotating suction arm 110. The cover can be adapted to tightly surround at least a portion of the nozzle 80 so as to effectively seal the nozzle openings 96 to the atmosphere.

Figure 7:
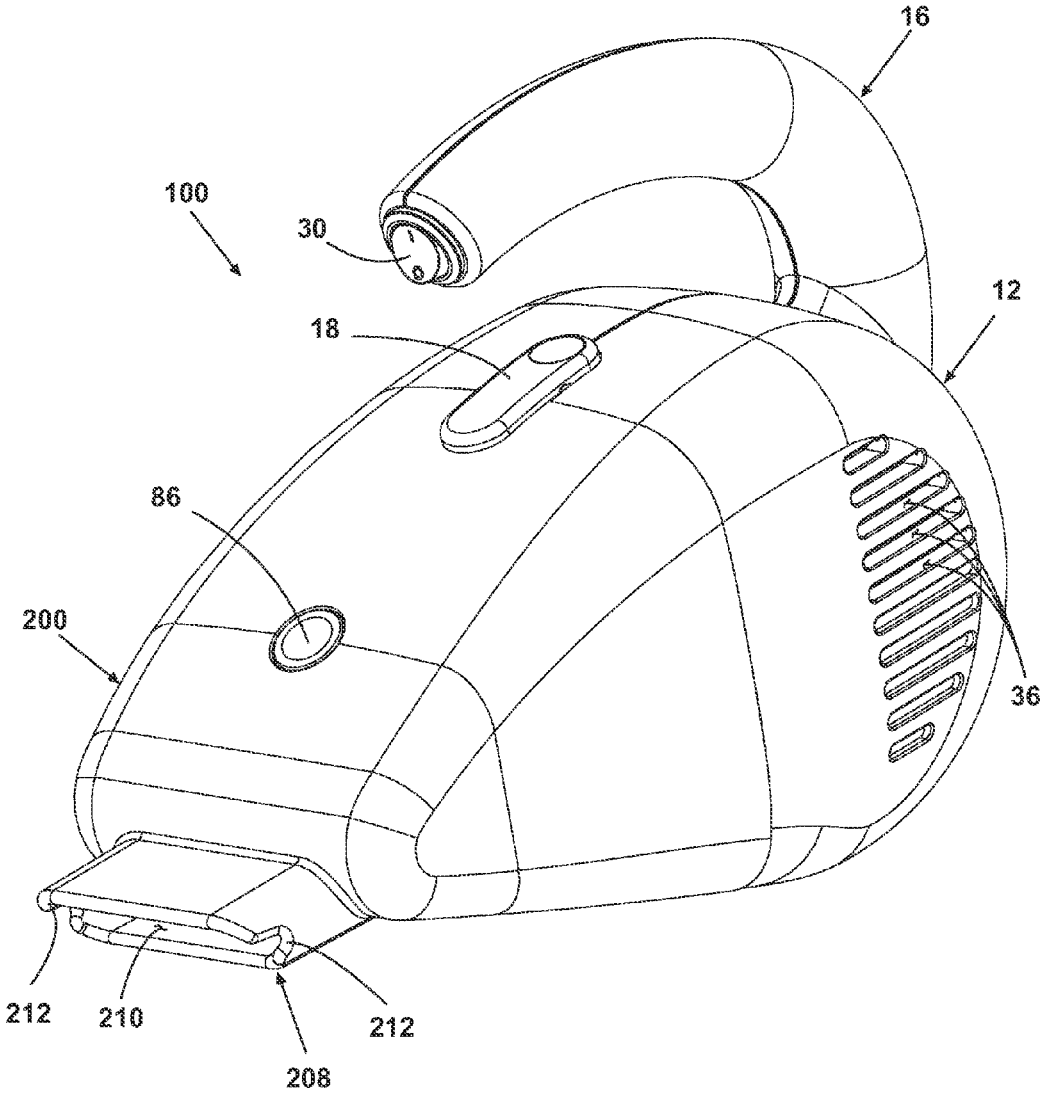
FIG. 7 is a perspective view of the handheld pet hair vacuum cleaner of FIG. 1 with a hard nozzle removably attached thereto.

FIG. 7 illustrates the vacuum cleaner 10 of FIGS. 1-3 with the flexible nozzle 80 replaced by a hard nozzle 200. The flexible nozzle 80 and hard nozzle 200 are interchangeable. The hard nozzle 200 is an integrally molded structure comprising a rounded body with a relatively thin nose 208 extending forwardly therefrom. An interfacing frame (not shown) similar to the interfacing frame 78 can be integrally molded into hard nozzle 200 and adapted for connection to the front end of 72 the dirt cup 14. The nose 208 includes an opening 210 in fluid connection with the working air conduit. The nose 208 includes two slightly recessed indentations 212 at two sides of the opening 210. The hard nozzle 200 can be formed of any relatively hard material, such as by a molded rubber relatively hard compared to the rubber of the flexible nozzle 80. The hard nozzle 200 comprises a nozzle latch receiving detent (not shown) identical to the nozzle latch receiving opening 90 adapted to releasably retain the nozzle latch 86 therein. When the hard nozzle 200 is connected to the dirt cup 14 by the nozzle latch 86, the hard nozzle 200, dirt cup 14, and housing 12 together form a working air conduit extending therethrough. The hard nozzle 200 can be attached and detached from the dirt cup 14 in the same manner as the flexible nozzle 80. The hard nozzle 200 can also be used with the vacuum cleaner 100, in which case an air flow control mechanism as discussed above can be included with the vacuum cleaner 100 or hard nozzle 200.

The operation of the vacuum cleaners 10, 100 will now be described with reference to the drawings. When the vacuum cleaner 10 is to be operated, the user first selects a desired nozzle for use with the vacuum cleaner. Depending on the type of surface being cleaned or the type of debris to be removed from the surface, the user can choose the flexible nozzle 80, the hard nozzle 200, or any other nozzle adapted for connection to the dirt cup 14 and suitable for the particular cleaning task. The user then attaches the appropriate nozzle to the dirt cup using the dirt cup latch 86. If the dirt cup 14 is not connected to the housing 12, the user connects the dirt cup 14 to the housing 12 using the dirt cup latch 18. If using the vacuum cleaner 100, the user can also choose to use the rotating suction arm 110, in which case the rotating suction arm 110 is rotated into the operational position. Alternatively, the user can first use the selected nozzle and then use the rotating suction arm 110 can be rotated into the operational position at a later time. If applicable, the user can operate the air flow control mechanism when the user desires to use the rotating suction arm 110.

Once the vacuum 10, 100 is assembled, the user connects the electrical cord to a power source or inserts batteries into the vacuum cleaner 10, 100, if necessary. The user actuates the power switch 30, which completes an electrical circuit from the power source to activate the motor/fan assembly 34. The resultant suction generated by the motor/fan assembly 34 creates a working airflow through the working air conduit in the vacuum cleaner 10, 100, which lifts dirt from the surface being cleaned through the nozzle or the rotating suction arm 110 depending upon the specific cleaning implement chosen by the user.

The dirt-laden working air travels through the dirt cup inlet 70 through the dirt cup 14 and is filtered first by the primary filter 57 and then pleated air filter 54. The filtered working air then flows through inlet 50 to the motor/fan assembly 34. After passing through the motor/fan assembly 34, the filtered working air flows through the exhaust filters 38. After being filtered by the exhaust filters 38, the twice-filtered working air is exhausted to the atmosphere through the exhaust openings 36. At any time during operation of the vacuum 100, the user can operate the air flow control mechanism, if applicable, and rotate the rotating suction arm 110 into operational position to use the rotating suction arm 110. After using the rotating suction arm 110, if the user desires to use the nozzle, the user can rotate the rotating suction arm 110 into the non-operational position and operate the air flow control mechanism, if applicable.

The invention provides a user with the ability to tailor vacuum cleaning to the specific surface being cleaned in order to most easily remove pet hair. By providing multiple nozzles and cleaning implements adapted to clean different types of surfaces and/or fabric, pet hair removal is made more efficient, and damage to delicate surfaces and fabrics can be prevented. In addition, the rotating suction arm 110 enables a user to reach into crevices and other areas that would normally be out of reach.

While the invention has been specifically described in connection with certain specific embodiments thereof, it is to be understood that this is by way of illustration and not of limitation, and the scope of the appended claims should be construed as broadly as the prior art will permit.

What is claimed is:

1. A handheld vacuum cleaner comprising:

a housing including a handle for carrying the vacuum cleaner, the housing having an inlet opening and a dirt cup connector surrounding the inlet opening;

a motor/fan assembly in the housing for generating a suction force through the inlet opening;

a dirt cup comprising a relatively hollow body having an inlet at a front end and an outlet at a back end, the back end of the dirt cup having a housing connector that is adapted to mate with the dirt cup connector to removably join the dirt cup to the housing;

a latch coupled between the dirt cup and the housing for selectively joining the dirt cup to the housing;

a filter positioned upstream of the motor/fan assembly;

a plurality of different nozzle assemblies, each having at least one nozzle opening and each having an outlet opening at a back end thereof that is removably coupled to the dirt cup front end;

a nozzle latch positioned between the dirt cup front end and each of the plurality of different nozzle assemblies for selectively coupling each of the plurality of different nozzle assemblies to the dirt cup front end; and an interfacing frame between the dirt cup and the at least one nozzle assembly molded of an elastomeric material;

wherein the interfacing frame is molded of a relatively rigid material and has an inner surface adapted to conform to at least a portion of the front end of the dirt cup and an outer surface including a plurality of ridges for frictionally retaining the at least one of the plurality of nozzle assemblies molded of an elastomeric material on the front end of the dirt cup.

2. The vacuum cleaner of claim 1 wherein one of the plurality of nozzle assemblies has pet hair removing elements.

3. The vacuum cleaner of claim 2 wherein the pet hair removing elements are formed of an elastomeric material.

4. The vacuum cleaner of any of claims 3 wherein one of the plurality of different nozzle assemblies includes a pair of spaced surfaces which are angularly related and each of the pair of spaced surfaces has one of the nozzle openings.

5. The vacuum cleaner of any of claims 1 wherein one of the plurality of different nozzle assemblies includes a pair of spaced surfaces which are angularly related and each of the pair of spaced surfaces has one of the nozzle openings.

6. The vacuum cleaner of any of claims 1 wherein each of the plurality of different nozzle assemblies is interchangeably coupled to the dirt cup by an interfacing frame.

7. The vacuum cleaner of any of claim 1 wherein the handle comprises a first end that is mounted to a rear portion of the housing and extends upwardly and forwardly ending in a free end.

8. The vacuum cleaner of claim 7 and further comprising a power switch connected to the motor/fan assembly on the free end of the handle for controlling power to the motor/fan assembly.

9. The vacuum cleaner of claim 1 and further comprising an elongated hollow suction arm having a connecting end and a suctioning end, wherein the suction arm is pivotally attached to the dirt cup at the connecting end for rotation from an operational position in which the suctioning end is extended beyond the nozzle assembly and non-operational position in which the suctioning end is positioned alongside the dirt cup, and wherein the connecting end has an opening in fluid communication with the dirt cup, and wherein the suctioning end comprises an elongated suction opening.

10. The vacuum cleaner of claim 1, wherein at least one of the plurality of nozzle assemblies is molded of an elastomeric material.

11. The vacuum cleaner of claim 1 wherein the nozzle latch is molded of an elastomeric material for removably retaining the at least one of the plurality of nozzle assemblies molded of an elastomeric material on the front end of the dirt cup.

12. The vacuum cleaner of claim 1 wherein the filter is positioned in the dirt cup between the inlet and the outlet thereof.

13. A handheld vacuum cleaner comprising:

a housing including a handle for carrying the vacuum cleaner, the housing having an inlet opening and a dirt cup connector surrounding the inlet opening;

a motor/fan assembly in the housing for generating a suction force through the inlet opening;

a dirt cup comprising a relatively hollow body having an inlet at a front end and an outlet at a back end, the back end of the dirt cup having a housing connector that is adapted to mate with the dirt cup connector to removably join the dirt cup to the housing;

a latch coupled between the dirt cup and the housing for selectively joining the dirt cup to the housing;

a filter positioned upstream of the motor/fan assembly;

a nozzle assembly having at least one nozzle opening in fluid communication with the dirt cup front end; and an elongated hollow suction arm having a connecting end and a suctioning end, wherein the suction arm is pivotally attached to the dirt cup at the connecting end for rotation from an operational position in which the suctioning end is extended beyond the nozzle assembly and a non-operational position in which the suctioning end is positioned alongside the dirt cup, and wherein the connecting end has an opening in fluid communication with the dirt cup, and wherein the suctioning end comprises an elongated suction opening.

14. The vacuum cleaner of claim 13, wherein the opening in the connecting end is formed in a bearing that is received within an opening in the dirt cup for rotatably mounting the suction arm to the dirt cup.

15. The vacuum cleaner of claim 14, wherein the bearing is snap fit into the opening in the dirt cup.

* * * * *